US008183199B2

(12) United States Patent
Fossum et al.

(10) Patent No.: US 8,183,199 B2
(45) **Date of Patent: *May 22, 2012**

(54) HEAT STABLE FABRIC SOFTENER

(75) Inventors: Renae Dianna Fossum, Middletown, OH (US); Jose Andres Rojo Moreno, Loveland, OH (US); Hugo Jean Marie Demeyere, Merchtem (BG); Kevin Lee Kott, Cincinnati, OH (US); Hans-Jurgen Kohle, Schluchtern (DE); Ulrike Kottke, Linsengericht (DE); Harald Jakob, Hasselroth (DE)

(73) Assignee: The Procter & Gamble Company, Cincinnati, OH (US)

( * ) Notice: Subject to any disclaimer, the term of this patent is extended or adjusted under 35 U.S.C. 154(b) by 114 days.

This patent is subject to a terminal disclaimer.

(21) Appl. No.: 12/752,220

(22) Filed: Apr. 1, 2010

(65) Prior Publication Data

US 2011/0239378 A1 Oct. 6, 2011

(51) Int. Cl.
*C11D 1/62* (2006.01)

(52) U.S. Cl. ..... 510/515

(58) Field of Classification Search ..... 510/515
See application file for complete search history.

(56) References Cited

U.S. PATENT DOCUMENTS

| | | | | |
|---|---|---|---|---|
| RE32,713 | E | 7/1988 | Woo | |
| 2003/0060390 | A1 | 3/2003 | Demeyere et al. | |
| 2003/0126282 | A1 | 7/2003 | Sarkar et al. | |
| 2003/0158344 | A1 | 8/2003 | Rodriques et al. | |
| 2003/0165692 | A1 | 9/2003 | Koch et al. | |
| 2003/0195133 | A1 | 10/2003 | Shefer et al. | |
| 2003/0203829 | A1 | 10/2003 | Shefer et al. | |
| 2003/0215417 | A1 | 11/2003 | Uchiyama et al. | |
| 2003/0216488 | A1 | 11/2003 | Uchiyama et al. | |
| 2004/0071742 | A1 | 4/2004 | Popplewell et al. | |
| 2004/0071746 | A1 | 4/2004 | Popplewell et al. | |
| 2004/0072719 | A1 | 4/2004 | Bennett et al. | |
| 2004/0072720 | A1 | 4/2004 | Brain et al. | |
| 2004/0087477 | A1 | 5/2004 | Ness | |
| 2004/0106536 | A1 | 6/2004 | Mane et al. | |
| 2004/0204337 | A1 | 10/2004 | Corona, III et al. | |
| 2006/0089293 | A1* | 4/2006 | Frankenbach | 510/515 |
| 2006/0094639 | A1* | 5/2006 | Martin et al. | 510/517 |
| 2007/0219111 | A1 | 9/2007 | Ward et al. | |
| 2008/0242584 | A1* | 10/2008 | Wahl et al. | 510/517 |
| 2008/0263780 | A1* | 10/2008 | Declercq et al. | 8/137 |
| 2009/0181887 | A1 | 7/2009 | Hansen et al. | |

FOREIGN PATENT DOCUMENTS

| | | | |
|---|---|---|---|
| DE | 2430140 | C3 | 10/1979 |
| DE | 3608093 | A1 | 9/1987 |
| EP | 0293955 | A2 | 1/1993 |
| EP | 0302567 | A2 | 2/1998 |
| EP | 1393706 | A1 | 3/2004 |
| WO | WO00/06678 | | 2/2000 |

OTHER PUBLICATIONS

U.S. Appl. No. 4/234,627, filed Nov. 1980, Schilling.
U.S. Appl. No. 4/514,461, filed Apr. 30, 1985, Woo, Yen-Kong.
U.S. Appl. No. 4/882,220, filed Nov. 21, 1989, Oro, et al.
U.S. Appl. No. 4/917,920, filed Apr. 17, 1990, Oro, et al.
U.S. Appl. No. 5/137,646, filed Aug, 11, 1992, Schmidt, et al.
U.S. Appl. No. 6/200,949, filed Mar. 13, 2001, Reijmer, et al.
U.S. Appl. No. 6/376,455, filed Apr. 23, 2002, Friedli, et al.
U.S. Appl. No. 6/492,322, filed Dec. 10, 2002, Cooper, et al.
U.S. Appl. No. 6/645,479, filed Nov. 3, 2003, Shefer, et al.
U.S. Appl. No. 4/789,491, filed Aug. 19, 2003, Borjesson et al.
U.S. Appl. No. 6/653,275, filed Nov. 25, 2003, Fender et al.
U.S. Appl. No. 7/704,940, filed Apr. 27, 2010, Boerefijn, et al.

* cited by examiner

*Primary Examiner* — John Hardee
(74) *Attorney, Agent, or Firm* — James F. McBride; Melissa G. Krasovec; Steven W. Miller

(57) ABSTRACT

A fabric softener composition, comprising 1% to 49% by weight of a bis-(2-hydroxypropyl)-dimethylammonium methylsulphate fatty acid ester having a molar ratio of fatty acid moieties to amine moieties of from 1.85 to 1.99, wherein the average chain length of the fatty acid moieties is from 16 to 18 carbon atoms and the iodine value of the fatty acid moieties, calculated for the free fatty acid, is from 0.5 to 50.

13 Claims, No Drawings

HEAT STABLE FABRIC SOFTENER

The present invention relates to fabric softener active compositions having high softening performance and good storage stability in aqueous formulations, which can be processed to aqueous formulations without the use of volatile solvents.

Quaternary ammonium salts carrying two hydrophobic long chain hydrocarbon moieties have found broad use as an active in fabric softener compositions. Quaternary ammonium salts of alkanolamines esterified with on average two fatty acid moieties per molecule, commonly referred to as ester quats, have largely replaced earlier alkyl quaternary ammonium actives in fabric softener compositions because of their biodegradability.

For use in rinse cycle softener products, a softener active composition has to meet several and sometimes conflicting requirements:

High softening performance in terms of soft touch and fabric rewettability, good storage stability in aqueous dispersion with little change in dispersion viscosity, and convenient handling and processing in a liquid state.

The ester quats which have found the broadest technical use and which today set the standard for softening performance are methyltriethanolammonium methylsulphate fatty acid diesters and dimethyldiethanolammonium chloride fatty acid diesters. However, aqueous dispersions of these fabric softener actives have limited stability and extended storage of such aqueous dispersions at temperatures in excess of 40° C. will usually lead to an inacceptable rise in dispersion viscosity or to settling of the softener active. Furthermore, these fabric softener actives cannot be handled and processed to aqueous dispersions without the addition of a solvent because of their high melting points and melt viscosities and the limited thermal and hydrolytic stability of the fabric softener actives. Therefore, they are usually delivered and processed with a content of 5 to 15% by weight ethanol or isopropanol, which requires additional precautions due to the volatility and flammability of the solvent.

EP 0 293 955 A2 and EP 0 302 567 A2 disclose aqueous fabric softener dispersions having high storage stability and little change in viscosity during storage and a method for preparing such dispersions. These compositions contain a bis-(2-hydroxypropyl)-dialkylammonium salt fatty acid diester as the fabric softener active in the form of submicrometer particles. However, preparation of these dispersions requires processing the fabric softener active mixed with from 5 to 50% by weight of a $C_1$-$C_4$ monohydric alcohol. In the examples, bis-(2-hydroxypropyl)-dimethylammonium chloride palmitic acid diester is used as the fabric softener active and isopropanol is used as the solvent.

DE 24 30 140 C3 discloses bis-(2-hydroxypropyl)-dialkylammonium salt fatty acid diesters for providing liquid fabric softener actives. Example 2 discloses the preparation of a bis-(2-hydroxypropyl)-dimethylammonium methylsulphate fatty acid diester by reacting a bis-(2-hydroxypropyl)-methylamine fatty acid diester of a fatty acid having an average chain length of 19 to 20 carbon atoms and comprising 90% by weight unsaturated fatty acid moieties with dimethylsulphate in a molar ratio of 1:1.

EP 1 018 541 A1 discloses clear fabric softener compositions comprising an ester quat and an alkoxylated phenol or branched $C_3$-$C_6$ alcohol solvent. Example 6 discloses a composition containing a bis-(2-hydroxypropyl)-dimethylammonium methylsulphate fatty acid ester having a molar ratio of fatty acid moieties to amine moieties of 1.8 derived from a fatty acid having an average chain length of 18 carbon atoms and an iodine value of about 150. The ester quat active is processed with addition of 10% by weight isopropanol when making this composition, as disclosed in paragraph [0026].

WO 00/06678 discloses incompletely esterified ester quats of branched chain alkanolamines, which are claimed to have low melting points and high hydrolytic stability, and proposes to leave on average one hydroxyl group of the alkanolamine non-esterified. Example 50 discloses a bis-(2-hydroxypropyl)-dimethylammonium methylsulphate fatty acid ester made by quaternising a bis-(2-hydroxypropyl)-methylamine fatty acid ester having a molar ratio of fatty acid moieties to amine moieties of 1.18 derived from a fatty acid having a chain length of 12 to 14 carbon atoms.

DE 36 08 093 A1 discloses concentrated aqueous fabric softener compositions comprising an ester quat with two acyl groups, a fatty acid or an alkali salt thereof in an amount of 1/70 to 1/3 of the amount of the ester quat and a solvent combination of water, glycerol and an additional organic solvent in a total amount of 1/6 to twice the amount of the ester quat. Example 4 discloses a composition containing 45% by weight bis-(2-hydroxypropyl)-dimethylammonium methylsulphate oleic acid diester, 1% by weight tallow fatty acid sodium salt, 11.5% by weight water, 11.5% by weight glycerol, 17.5% by weight 2-propanol, 6% by weight propylene glycol and 3% by weight dipropylene glycol.

The ester quat actives disclosed in DE 24 30 140 C3, EP 1 018 541 A1 and WO 00/06678 have low melting points, but provide insufficient softening performance due to the high degree of unsaturation of the fatty acid moieties or the high content of monoester quat component. On the other hand, similar ester quats derived from bis-(2-hydroxypropyl)-methylamine with a low content of monoester quat, made from fatty acids with a low degree of unsaturation, as the one disclosed in EP 302 567 A2, provide the required softening performance, but show high melting points and melt viscosities and therefore require addition of a solvent for handling and processing.

Therefore, there is still a need for fabric softener actives which can be handled and processed without a solvent without compromising storage stability in aqueous dispersion with little change in dispersion viscosity.

It has now been found that fabric softener active compositions (and fabric softener composition comprising the same) based on a bis-(2-hydroxypropyl)-dimethylammonium methylsulphate fatty acid ester made from fatty acids with a specific chain length and a specific degree of unsaturation and having a particular molar ratio of fatty acid moieties to amine moieties, which comprise a specific amount of free fatty acid, provide high softening performance and good storage stability in aqueous dispersion, and at the same time can be handled and processed in a liquid state without addition of a flammable solvent.

The present invention is therefore directed to a fabric softener active composition, comprising least 50% by weight of a bis-(2-hydroxypropyl)-dimethylammonium methylsulphate fatty acid ester having a molar ratio of fatty acid moieties to amine moieties of from 1.85 to 1.99, an average chain length of the fatty acid moieties of from 16 to 18 carbon atoms and an iodine value of the fatty acid moieties, calculated for the free fatty acid, of from 0.5 to 60, and from 0.5 to 5% by weight fatty acid. The invention is also directed to fabric softener composition comprising from the aforementioned fabric softener active compositions. The fabric softener composition of the present invention comprises from 1% to 49% of the bis-(2-hydroxypropyl)-dimethylammonium methylsulphate fatty acid ester.

The invention is also directed to a method for making such compositions, comprising the steps of reacting bis-(2-hydroxypropyl)-methylamine with a fatty acid having an average chain length of from 16 to 18 carbon atoms and an iodine value of from 0.5 to 50 in a molar ratio of fatty acid to amine of from 1.86 to 2.1 with removal of water until the acid value of the reaction mixture is in the range from 1 to 10 mg KOH/g and further reacting with dimethylsulphate at a molar ratio of dimethylsulphate to amine of from 0.90 to 0.97 and preferably from 0.92 to 0.95 until the total amine value of the reaction mixture is in the range from 1 to 8 mg KOH/g. The invention also directed to methods of making fabric softener composition comprising the aforementioned steps and further comprising hydrating the fabric softener active composition; adding an adjunct ingredient, such as perfume, to the composition to form a fabric softener composition comprising from 1% to 49% of the of the bis-(2-hydroxypropyl)-dimethylammonium methylsulphate fatty acid ester.

The fabric softener active composition of the invention comprises at least 50% by weight of a bis-(2-hydroxypropyl)-dimethylammonium methylsulphate fatty acid ester. The composition preferably comprises from 85 to 99% by weight of said ester. The fabric softener composition of the invention comprises from 1% to 49% of a bis-(2-hydroxypropyl)-dimethylammonium methylsulphate fatty acid ester. In embodiment, the composition comprises from 2% to 25%, alternatively from 3% to 20%, alternatively from 10% to 15%, alternatively from 4% to 7% of a bis-(2-hydroxypropyl)-dimethylammonium methylsulphate fatty acid ester.

The bis-(2-hydroxypropyl)-dimethylammonium methylsulphate fatty acid ester is a mixture of at least one diester of formula $(CH_3)_2N^+(CH_2CH(CH_3)OC(=O)R)_2CH_3OSO_3^-$ and at least one monoester of formula $(CH_3)_2N^+(CH_2CH(CH_3)OH)(CH_2CH(CH_3)OC(=O)R)CH_3OSO_3^-$, where R is the hydrocarbon group of a fatty acid moiety RCOO. The bis-(2-hydroxypropyl)-dimethylammonium methylsulphate fatty acid ester has a molar ratio of fatty acid moieties to amine moieties of from 1.85 to 1.99. The specified molar ratio is essential for simultaneously achieving high softening performance and low melting point of the composition. If the molar ratio is lower than 1.85, the softening performance will be unsatisfactory.

The fatty acid moiety of the bis-(2-hydroxypropyl)-dimethylammonium methylsulphate fatty acid ester is derived from a mixture of fatty acids of formula RCOOH, where R is a hydrocarbon group. The hydrocarbon group may be branched or unbranched and preferably is unbranched.

The fatty acid moiety has an average chain length of from 16 to 18 carbon atoms and an iodine value, calculated for the free fatty acid, of from 0.5 to 50. The average chain length is preferably from 16.5 to 17.8 carbon atoms. Preferably, the iodine value is from 5 to 40 and more preferably from 15 to 35. The average chain length is calculated on the basis of the weight fraction of individual fatty acids in the mixture of fatty acids. For branched chain fatty acids the chain length refers to the longest consecutive chain of carbon atoms. The iodine value is the amount of iodine in g consumed by the reaction of the double bonds of 100 g of fatty acid, determined by the method of ISO 3961. In order to provide the required average chain length and iodine value, the fatty acid moiety is derived from a mixture of fatty acids comprising both saturated and unsaturated fatty acids. The unsaturated fatty acids are preferably monounsaturated fatty acids. The bis-(2-hydroxypropyl)-dimethylammonium methylsulphate preferably comprises less than 6% by weight of multiply unsaturated fatty acid moieties. Examples of suitable saturated fatty acids are palmitic acid and stearic acid. Examples of suitable monounsaturated fatty acids are oleic acid and elaidic acid. The cis-trans-ratio of double bonds of unsaturated fatty acid moieties is preferably higher than 55:45, more preferably higher than 65:25, and more preferably higher than 75:25, respectively. In one embodiment, the cis-tran-ratio is from 55:45 to 75:25, respectively. The fraction of multiply unsaturated fatty acid moieties may be reduced by selective touch hydrogenation, which is a hydrogenation that selectively hydrogenates one double bond in a —CH═CH—$CH_2$—CH═CH— substructure but not double bonds of monounsaturated hydrocarbon groups. The specified average chain length and iodine values are essential for simultaneously achieving high softening performance and low melting point of the composition. If the average chain length is less than 16 carbon atoms or the iodine value is higher than 50, the softening performance will be unsatisfactory, whereas the melting point of the composition can get too high if the average chain length is more than 18 carbon atoms.

The fatty acid moiety may be derived from fatty acids of natural or synthetic origin and is preferably derived from fatty acids of natural origin, most preferably from fatty acids of plant origin. The required iodine value can be provided by using a fatty acid mixture of natural origin that already has such an iodine value, for example a tallow fatty acid. Alternatively, the required iodine value can be provided by partial hydrogenation of a fatty acid mixture or a triglyceride mixture having a higher iodine value. In a further and preferred embodiment, the required iodine value is provided by mixing a fatty acid mixture having a higher iodine value with a mixture of saturated fatty acids. The mixture of saturated fatty acids may be obtained either by hydrogenating a fatty acid mixture containing unsaturated fatty acids or from a hydrogenated triglyceride mixture, such as a hydrogenated vegetable oil.

The fabric softener composition of the present invention further comprises from 0.005 to 2.5% by weight fatty acid in addition to the bis-(2-hydroxypropyl)-dimethylammonium methylsulphate fatty acid ester. The fabric softener active composition comprises from 0.5% to 5% by weight fatty by weight fatty acid in addition to the bis-(2-hydroxypropyl)-dimethylammonium methylsulphate fatty acid ester. The fabric softener composition preferably comprises from 0.01 to 1% and more preferably from 0.2 to 0.85% by weight fatty acid. The fabric softener active composition comprises composition preferably comprises from 0.01 to 1% and more preferably from 1 to 5% by weight fatty acid. The fatty acid may be present as free fatty acid or in the form of a salt of the fatty acid with non-quaternised bis-(2-hydroxypropyl)-methylamine esters. The fabric softener active composition (and fabric softener composition) preferably comprises a fatty acid mixture, which is preferably of natural origin and most preferably of plant origin. In the most preferred embodiment, the fatty acid moieties of the bis-(2-hydroxypropyl)-dimethylammonium methylsulphate fatty acid ester are derived from the same fatty acid mixture as present in the fabric softener composition in an amount of from 0.005 to 2.5% by weight (and 0.5% to 5% in the fabric softener active composition). The specified amount of fatty acid is essential for achieving a low melting point of the composition without compromising storage stability in aqueous dispersion. If the fabric softening active composition comprises less than 0.5% by weight fatty acid, the melting point of the composition can get too high, whereas a content of more than 5% by weight fatty acid in the composition will have the effect that aqueous dispersions prepared from the composition have unsuitably high viscosities and low dispersion stability. By adjusting the amount of fatty acid within the claimed range, compositions of the present invention can be made which have low melt viscosities without using any solvent or diluent. Such fabric softening active compositions enable the manufacture of aqueous rinse cycle softener dispersions containing no solvent or a minimum amount of solvent.

The fabric softener active composition of the present invention preferably comprises less than 2% by weight and more preferably less than 0.5% by weight of water. Compositions having such low water content show improved storage stability in the molten state and therefore can be stored and delivered as liquids without compromising product quality. Compositions comprising more water show a much higher melt viscosity and are therefore difficult to process into an aqueous dispersion.

The fabric softener compositions comprise from 51% to 99% water by weight. The fabric softener active composition of the present invention preferably comprises less than 10% by weight, more preferably less that 5% and more preferably less than 2% by weight of solvents having a flash point of less than 20° C. The fabric softener composition compositions comprise less than 1%, alternatively less than 0.1%, alternatively less than 0.01% by weight of solvents having a flash point of less than 20° C.

In a preferred embodiment, the fabric softener active composition of the present invention comprises up to 20%, alternatively up to 10%, alternatively up to 9.9% by weight, alternatively up to 5%, alternatively from 0.1% to 20%, alternatively combinations thereof, by weight of at least one solvent selected from glycerol, ethylene glycol, propylene glycol, dipropylene glycol and $C_1$-$C_4$ alkyl monoethers of ethylene glycol, propylene glycol and dipropylene glycol. Examples of suitable glycol $C_1$-$C_4$ alkyl monoethers are 2-methoxyethanol, 2-ethoxyethanol, 2-butoxyethanol, 1-methoxy-2-propanol, dipropylene glycol monomethyl ether and dipropylene glycol monobutyl ether. The compositions according to this embodiment have the advantages of low melt viscosity and a close to Newtonian melt rheology, i.e. the viscosity shows little change with shear strength.

In another preferred embodiment, the fabric softener active composition of the present invention comprises from 2 to 8% by weight of a fatty acid triglyceride having an average chain length of the fatty acid moieties of from 10 to 14 carbon atoms and an iodine value, calculated for the free fatty acid, of from 0 to 15. Compositions according to this embodiment also have the advantages of low melt viscosity and a close to Newtonian melt rheology, i.e. the viscosity shows little change with shear strength.

In another preferred embodiment, the fabric softener composition of the present invention comprises less than 2% preferably less than 1.5%, preferably less than 1%, alternatively from 0.015% to 1% by weight of a fatty acid triglyceride having an average chain length of the fatty acid moieties of from 10 to 14 carbon atoms and an iodine value, calculated for the free fatty acid, of from 0 to 15. Fabric softening active compositions according to this embodiment also have the advantages of low melt viscosity and a close to Newtonian melt rheology, i.e. the viscosity shows little change with shear strength.

In a preferred alternative embodiment, the amount of solvents present in the fabric softener active composition is less than 5% by weight and more preferably less than 1% by weight. The compositions according to this embodiment can be further processed in a molten state to provide aqueous solvent free dispersions.

In one embodiment, the fabric softener composition comprises less than 0.5%, alternatively less than 0.1%, alternatively less than 0.01%, alternatively free or essentially free, alternatively from 0.5% to 0.001% of the solvents.

In addition to a bis-(2-hydroxypropyl)-dimethylammonium methylsulphate fatty acid ester, a fatty acid and optionally a solvent, the fabric softener active composition of the present invention may preferably further comprise from 1.5 to 9% by weight of a bis-(2-hydroxypropyl)-methylamine fatty acid ester containing the same fatty acid moieties as the bis-(2-hydroxypropyl)-dimethylammonium methylsulphate fatty acid ester. The bis-(2-hydroxypropyl)-methylamine fatty acid ester is preferably a mixture of at least one diester of formula $(CH_3)N(CH_2CH(CH_3)OC(=O)R)_2$ and at least one monoester of formula $(CH_3)N(CH_2CH(CH_3)OH)(CH_2CH(CH_3)OC(=O)R)$. At least part of the bis-(2-hydroxypropyl)-methylammonium methylsulphate fatty acid ester will be present in the form of a salt with the fatty acid of the fabric softener active composition. Such salts are of structure $HN^+(CH_3)(CH_2CH(CH_3)OC(=O)R)_2RCCO^-$ or $HN^+(CH_3)(CH_2CH(CH_3)OH)(CH_2CH(CH_3)OC(=O)R)RCOO^-$. The presence of the bis-(2-hydroxypropyl)-dimethylamine fatty acid ester in the specified amount further lowers the melting point of the composition, without compromising softening performance and storage stability in aqueous dispersions.

The fabric softener active composition of the present invention can be prepared by mixing the bis-(2-hydroxypropyl)-dimethylammonium methylsulphate fatty acid ester, the fatty acid and the optional components, such as solvent or bis-(2-hydroxypropyl)-methylamine fatty acid ester. Preferably, the fabric softener active composition of the present invention is prepared by the method of the invention, comprising the steps of reacting bis-(2-hydroxypropyl)-methylamine with a fatty acid having an average chain length of from 16 to 18 carbon atoms and an iodine value of from 0.5 to 50 in a molar ratio of fatty acid to amine of from 1.86 to 2.1 with removal of water until the acid value of the reaction mixture is in the range from 1 to 10 mg KOH/g and further reacting with dimethylsulphate at a molar ratio of dimethylsulphate to amine of from 0.90 to 0.97 and preferably from 0.92 to 0.95 until the total amine value of the reaction mixture is in the range from 1 to 8 mg KOH/g.

In the first step of the method of the invention, bis-(2-hydroxypropyl)-methylamine is reacted with the fatty acid in a molar ratio of fatty acid to amine of from 1.86 to 2.1 with removal of water. The reaction is preferably carried out at a temperature of from 160 to 220° C. Water is preferably removed by distillation from the reaction mixture. During the course of the reaction, the pressure is preferably reduced from ambient pressure to a pressure in the range from 100 to 5 mbar to enhance the removal of water. The first step may be carried out in the presence of an acidic catalyst, which is preferably used in an amount of from 0.05 to 0.2% by weight. Suitable acidic catalysts are methanesulfonic acid and p-toluenesulfonic acid The reaction is carried out until the acid value of the reaction mixture is in the range from 1 to 10 mg KOH/g. The acid value is determined by titration with a standardised alkaline solution according to ISO 660 and is calculated as mg KOH per g sample. The reaction can then be stopped by cooling to a temperature below 80° C. in order to avoid further reaction of the fatty acid and maintain unreacted fatty acid to achieve the required amount of fatty acid in the final product.

In the second step of the method of the invention, the reaction mixture obtained in the first step is reacted with dimethylsulphate at a molar ratio of dimethylsulphate to amine of from 0.90 to 0.97 and preferably from 0.92 to 0.95. The reaction is preferably carried out at a temperature of from 60 to 100° C. The reaction is carried out until the total amine value of the reaction mixture is in the range from 1 to 8 mg KOH/g. The total amine value is determined by non-aqueous titration with perchloric acid according to method Tf 2a-64 of the American Oil Chemists Society and is calculated as mg KOH per g sample.

The method of the invention has the advantage of providing a fabric softener active composition according to the invention without requiring any step in addition to the steps needed for manufacturing the bis-(2-hydroxypropyl)-dimethylammonium methylsulphate fatty acid ester. This advantage is achieved by the appropriate choice of the molar ratio of fatty acid to amine and by carrying out the reaction of fatty acid and amine to the specified range of the acid value, maintaining a fraction of unreacted fatty acid.

Fabric Softener Adjunct Ingredients

Fabric softeners typically comprise from 1% to 49%, alternatively from 2% to 20%, alternatively from 3% to 17%, alternatively from 5% to 15%, alternatively combinations thereof, of a bis-(2-hydroxypropyl)-dimethylammonium methylsulphate fatty acid ester by weight of the composition.

One aspect of the invention provides fabric softening composition comprising cationic polymers for aiding in depositions and/or rheology benefits. See e.g., U.S. Pat. No. 6,492,322 B1; US 2006-0094639. In one embodiment, the composition comprises from about 0.1% to about 5%, preferably from 0.7% to 2.5%, by weight of a cationic cross-linked polymer that is desirable from the polymerization of from 5 to 100 mole present of cationic vinyl addition monomer, from 0 to 95 mole percent of acrylamide and from 50 to 1000 parts per million (ppm), preferably 350 to 100 ppm, more preferably 500 to 1000 ppm of a vinyl addition monomer cross-linking agent. An example of such polymer may include Rheovis CDE from Ciba (BASF).

Adjunct ingredients that may be added to the compositions of the present invention. The ingredients may include: suds suppressor, preferably a silicone suds suppressor (US 2003/0060390 A1, ¶ 65-77), cationic starches (US 2004/0204337 A1; US 2007/0219111 A1); scum dispersants (US 2003/0126282 A1, ¶89-90); perfume and perfume microcapsules (U.S. Pat. No. 5,137,646); nonionic surfactant, non-aqueous solvent, fatty acid, dye, preservatives, optical brighteners, antifoam agents, and combinations thereof.

Other adjunct ingredients may include: dispersing agent, stabilizer, pH control agent, metal ion control agent, colorant, brightener, dye, odor control agent, pro-perfume, cyclodextrin, solvent, soil release polymer, preservative, antimicrobial agent, chlorine scavenger, enzyme, anti-shrinkage agent, fabric crisping agent, spotting agent, anti-oxidant, anti-corrosion agent, bodying agent, drape and form control agent, smoothness agent, static control agent, wrinkle control agent, sanitization agent, disinfecting agent, germ control agent, mold control agent, mildew control agent, antiviral agent, antimicrobial, drying agent, stain resistance agent, soil release agent, malodor control agent, fabric refreshing agent, chlorine bleach odor control agent, dye fixative, dye transfer inhibitor, color maintenance agent, color restoration/rejuvenation agent, anti-fading agent, whiteness enhancer, anti-abrasion agent, wear resistance agent, fabric integrity agent, anti-wear agent, and rinse aid, UV protection agent, sun fade inhibitor, insect repellent, anti-allergenic agent, enzyme, flame retardant, water proofing agent, fabric comfort agent, water conditioning agent, shrinkage resistance agent, stretch resistance agent, enzymes, cationic starch, and combinations thereof. In one embodiment, the composition comprises one or more adjunct ingredient up to about 2% by weight of the composition. In yet another embodiment, the composition of the present invention may be free or essentially free of any one or more adjunct ingredients. In yet another embodiment, the composition is free or essentially free of detersive laundry surfactants.

In one embodiment, the pH of the composition may comprise a pH of from about 2 to about 6, preferably from about 2 to about 5, and more preferably from about 2.5 to about 4.

In one embodiment, the composition of the present invention further comprises a perfume microcapsule. Suitable perfume microcapsules may include those described in the following references: US 2003-215417 A1; US 2003-216488 A1; US 2003-158344 A1; US 2003-165692 A1; US 2004-071742 A1; US 2004-071746 A1; US 2004-072719 A1; US 2004-072720 A1; EP 1393706 A1; US 2003-203829 A1; US 2003-195133 A1; US 2004-087477 A1; US 2004-0106536 A1; U.S. Pat. No. 6,645,479; U.S. Pat. No. 6,200,949; U.S. Pat. No. 4,882,220; U.S. Pat. No. 4,917,920; U.S. Pat. No. 4,514,461; U.S. RE 32713; U.S. Pat. No. 4,234,627. In another embodiment, the perfume microcapsule comprises a friable microcapsule (e.g., aminoplast copolymer comprising perfume microcapsule, esp. melamine-formaldehyde or urea-formaldehyde). In another embodiment, the perfume microcapsule comprises a moisture-activated microcapsule (e.g., cyclodextrin comprising perfume microcapsule). In another embodiment, the perfume microcapsule may be coated with a polymer (alternatively a charged polymer)). US published patent application claiming priority to U.S. Provisional Application Ser. No. 61/258,900, filed Nov. 6, 2009 may describe such coated perfume microcapsules.

In one aspect of the invention, a method of softening or treating a fabric is provided. In one embodiment, the method comprises the step of obtaining a composition of the present invention. In another embodiment, the method comprises the step of administering a composition of the present invention to a rinse cycle of an automatic laundry machine or a hand washing laundry rinse basin. The term "administering" means causing the composition to be delivered to a rinse bath solution. Examples of administering include, for example, dispensing the composition in an automatic fabric softener dispenser that is integral to the laundry washing machine whereby the dispenser dispenses the composition at the appropriate time during the laundry washing process, e.g., last rinse cycle. Another example is dispensing the composition in a device, such a DOWNY BALL, wherein the device will dispense the composition at the appropriate time during the laundry washing process. In another embodiment, a composition of the present invention is dosed in a first rinse bath solution or a dosed in a single rinse bath solution. This is particularly convenient in a hand washing context. See e.g., U.S. Pat. Appl. No. 2003-0060390 A1. In one embodiment, a method of softening a fabric in a manual rinse processes comprising the steps: (a) adding a fabric softening composition of the present invention to a first rinse bath solution; (b) rinsing manually the fabric in the first rinse bath solution; (c) optionally the fabric softening composition comprises a suds suppressor. A method of reducing the volume of water consumed in a manual rinse process comprises the aforementioned step is also provided.

The invention is illustrated by the following examples, which are however not intended to limit the scope of the invention in any way.

EXAMPLES

General:

Table 1 lists the sources, fatty acid chain length distributions and iodine values of fatty acids A to G that were used in the examples. Fatty acid chain length distributions were determined by GC after derivatisation of the fatty acid as methyl ester.

Fabric softener active compositions were prepared by the following general procedure, unless specified otherwise in the individual examples. The fatty acid was placed in an electrically heated reactor equipped with a thermometer, a mechanical stirrer and a rectifying column and the bis-(2-hydroxypropyl)-methylamine was added with stirring. The resulting mixture was heated with stirring to 200° C. and was kept at this temperature for 4 h at ambient pressure, distilling off water through the rectifying column. The pressure was then reduced to 10 mbar and the mixture was further stirred for at 200° C., water being removed with a vacuum pump, for the time specified in the individual example until the desired acid value of the reaction mixture was reached. The resulting mixture was then cooled to 75° C., dimethylsulphate was added and the resulting mixture was stirred for 2 h at 75° C.

Contents of free amine, amine salt and fatty acid in the fabric softener active composition were determined by non-aqueous potentiometric titration with tetrabutylammonium hydroxide after addition of an excess of a solution of HCl in 2-propanol.

Fractions of monoester and diester in the bis-(2-hydroxypropyl)-dimethylammonium methylsulphate fatty acid ester were determined by HPLC (Waters Spherisorb® SCX column, methanol eluent with a formic acid triethylamine buffer, RI detection).

Melting points were determined by the capillary method as the upper temperature of the melting range using a heating rate of 1° C./min. Samples were conditioned by melting the composition, homogenizing the melt, shock solidifying the melt by pouring it onto a cold metal plate and cooling the shock solidified melt to −16° C. for at least 4 h before transferring it to a melting point capillary.

Melt viscosities were measured at 70° C. with a StressTech rheometer of REOLOGICA® instruments using 40 mm parallel plates, a plate distance of 0.5 mm and shear rates of 1, 10 and 100 $s^{-1}$.

Storage stability was determined for 10% by weight aqueous dispersions of the fabric softener active compositions that were stored for 6 weeks at 50° C. in closed glass bottles. Dispersions were prepared by first dispersing a melt of the fabric softener active composition heated to 5 to 10° C. above the melting point in a 0.05% by weight aqueous HCl solution preheated to 5° C. below the melting point of the composition using an IKA Super-Dispax-Reactor® SD 41 operated at 8000 $min^{-1}$. Thereafter, a 25% by weight aqueous solution of $CaCl_2$ was added with stifling to provide a $CaCl_2$ concentration of 0.025% by weight. Acid values of the dispersions were determined before and after storage by acid-base-titration with KOH or NaOH and are given as mg KOH/g dispersion. Viscosity of the dispersions before and after storage was determined at 20° C. with a Brookfield viscometer using spindle number 1 for viscosities up to 100 mPa*s and spindle number 2 for viscosities higher than 100 mPa*s.

The softening performance of a fabric softener active composition was determined in a tactile test performed by a panel of test persons on pieces of cotton towel treated with an aqueous dispersion of the composition. 80 cm by 50 cm pieces of terry cloth cotton towel were washed twice with a heavy duty powder detergent, rinsed twice with intermediate and final spinning and dried in air hanging on a line. Samples of the 10% by weight aqueous dispersions of the fabric softener active compositions prepared as described above were diluted with cold tap water to give 21 of a rinse solution containing 0.025% by weight fabric softener active composition. The washed cotton towel pieces were immersed in this rinse solution for 10 min, spun and dried in air at ambient temperature hanging on a line. Thereafter, the treated cotton towel pieces were cut in 10 equal pieces of 16 cm by 25 cm, which were distributed to a panel of 9 test persons who rated the softness on a scale ranging from 0 for hard and a bad feel to 5 for soft and a good feel. The softness rating given in the examples is the sum of the nine individual ratings and can therefore range from 0 to 45. Differences in the softness rating of more than 4 are statistically significant, as determined from comparative repeat experiments.

TABLE 1

Sources, fatty acid chain length distributions and iodine values of fatty acids

| | Fatty acid | | |
|---|---|---|---|
| | A | B | C |
| | Source | | |
| | talloil* | tallow, partially hydrogenated | rapeseed |
| C12(0) | | | |
| C14(0) | | 2.1 | |
| C15(0) | | 0.4 | |
| C16(0) | 0.7 | 27.9 | 3.2 |
| C16(1) | | 0.7 | |
| C17(0) | 0.2 | 1.1 | |
| C18(0) | 1.8 | 48.1 | 1.0 |
| C18(1) | 29.3 | 15.1 | 17.1 |
| C18(2) | 46.3 | 0.9 | 12.7 |
| C18(3) | 0.9 | | 7.3 |
| C20(0) | 0.2 | 0.9 | 0.7 |
| C20(1) | 0.4 | | 7.9 |
| C22(0) | | | 0.7 |
| C22(1) | | | 45.9 |
| C22(2) | | | 0.7 |
| C24(0) | | | 0.2 |
| C24(1) | | | 0.8 |
| Average chain length | 18.0 | 17.3 | 20.1 |
| Iodine value | 150 | 20 | 102 |

| | Fatty acid | | | |
|---|---|---|---|---|
| | D | E | F | G |
| | Source | | | |
| | vegetable blend | coconut, hydrogenated | vegetable blend, partially hydrogenated | vegetable blend, hydrogenated |
| C12(0) | | 46.4 | | |
| C14(0) | 0.2 | 53.6 | 0.8 | 2.6 |
| C16(0) | 19.2 | | 45.3 | 46.4 |
| C16(1) | 0.5 | | | |
| C18(0) | 21.2 | | 13.4 | 49.3 |
| C18(1) | 47.6 | | 37.2 | |
| C18(2) | 7.9 | | 1.9 | |
| C18(3) | | | | |
| C20(0) | 0.3 | | 0.2 | 1.9 |
| C20(1) | 0.2 | | | |
| C22(0) | | | | |
| C22(1) | | | | |
| C22(2) | | | | |
| C24(0) | | | | |
| C24(1) | | | | |
| Average chain length | 17.6 | 13.1 | 17.1 | 17.0 |
| Iodine value | 61 | 0.1 | 37 | 0.7 |

Cx(y) denotes a linear fatty acid with x carbon atoms and y double bonds.

*20% of fatty acids could not be saponified and analysed.

Example 1

Comparative Example, Corresponds to Component A5 of EP 1 018 541 A1

644 g (2.25 mol) fatty acid A was esterified with 182.5 g (1.25 mol) bis-(2-hydroxypropyl)-methylamine at 190° C. with 8 h reaction at reduced pressure until the acid value of the reaction mixture was 0.6 mg KOH/g. The resulting mixture was reacted with 151 g (1.20 mol) dimethylsulphate at 60° C. The resulting fabric softener active composition was a brownish viscous liquid, containing 0.015 mmol/g (0.5% by weight) fatty acid and 0.070 mmol/g non-quaternised amine (0.041 mmol/g free amine and 0.029 mmol/g protonated amine). HPLC analysis showed the bis-(2-hydroxypropyl)-dimethylammonium methylsulphate fatty acid ester to be comprised of 8.2% monoester and 91.8% diester (rel. area percentages).

The composition had a melt viscosity of 685 mPa*s at 1 $s^{-1}$, 488 mPa*s at 10 $s^{-1}$ and 431 mPa*s at 100 $s^{-1}$ shear rate.

The 10% aqueous dispersion had an acid value of 0.6 mg KOH/g and a viscosity of 34 mPa*s before storage and an acid value of 1.2 mg KOH/g and a viscosity of 265 mPa*s after storage for 6 weeks at 50° C.

The composition achieved a softness rating of 12.

Example 2

Example 1 was repeated using 954 g (3.49 mol) of fatty acid B, 283 g (1.94 mol) bis-(2-hydroxypropyl)-methylamine and 235 g (1.86 mol) dimethylsulphate. The resulting fabric softener active composition was a white solid with a melting point of 42° C., containing 0.025 mmol/g (0.7% by weight) fatty acid and 0.059 mmol/g non-quaternised amine (0.033 mmol/g free amine and 0.026 mmol/g protonated amine). HPLC analysis showed the bis-(2-hydroxypropyl)-dimethylammonium methylsulphate fatty acid ester to be comprised of 8.8% monoester and 91.2% diester (rel. area percentages).

The composition had a melt viscosity of 47200 mPa*s at 1 $s^{-1}$, 9880 mPa*s at 10 $s^{-1}$ and 2960 mPa*s at 100 $s^{-1}$ shear rate.

The 10% aqueous dispersion had an acid value of 0.5 mg KOH/g and a viscosity of 18 mPa*s before storage and an acid value of 1.1 mg KOH/g and a viscosity of 18 mPa*s after storage for 6 weeks at 50° C.

The composition achieved a softness rating of 32.

Example 3

Comparative Example, Corresponds to Example 2 of DE 24 30 140 C3

744.5 g (2.38 mol) fatty acid C was esterified with 174.1 g (1.19 mol) bis-(2-hydroxypropyl)-methylamine with 15 h reaction at reduced pressure until the acid value of the reaction mixture was 1.5 mg KOH/g. The resulting mixture was reacted with 142.5 g (1.13 mol) dimethylsulphate for 4 h.

The resulting fabric softener active composition was a yellowish gel, containing 0.032 mmol/g (1.0% by weight) fatty acid and 0.113 mmol/g non-quaternised amine (0.042 mmol/g free amine and 0.071 mmol/g protonated amine). The amounts of monoester and diester in the bis-(2-hydroxypropyl)-dimethylammonium methylsulphate fatty acid ester could not be determined by HPLC analysis.

The composition had a melt viscosity of 561 mPa*s at 1 $s^{-1}$, 535 mPa*s at 10 $s^{-1}$ and 469 mPa*s at 100 $s^{-1}$ shear rate.

A 10% by weight aqueous dispersion prepared with 0.025% by weight $CaCl_2$ was very viscous. Therefore, the dispersion for the stability test was prepared with a fourfold amount of $CaCl_2$, i.e. 0.1% by weight $CaCl_2$. The dispersion had an acid value of 0.7 mg KOH/g and a viscosity of 160 mPa*s before storage and an acid value of 1.4 mg KOH/g and a viscosity of 270 mPa*s after storage for 6 weeks at 50° C.

The composition achieved a softness rating of 24.

Example 4

Example 3 was repeated using 948 g (3.47 mol) of fatty acid B, 253.4 g (1.735 mol) bis-(2-hydroxypropyl)-methylamine and 208 g (1.65 mol) dimethylsulphate with 15 h reaction at reduced pressure until the acid value of the reaction mixture was 1.4 mg KOH/g. The resulting fabric softener active composition was a white solid with a melting point of 43° C., containing 0.032 mmol/g (0.9% by weight) fatty acid and 0.073 mmol/g non-quaternised amine (0.043 mmol/g free amine and 0.030 mmol/g protonated amine). HPLC analysis showed the bis-(2-hydroxypropyl)-dimethylammonium methylsulphate fatty acid ester to be comprised of 3.1% monoester and 96.9% diester (rel. area percentages).

The composition had a melt viscosity of 36200 mPa*s at 1 $s^{-1}$, 7440 mPa*s at 10 $s^{-1}$ and 2160 mPa*s at 100 $s^{-1}$ shear rate.

The 10% aqueous dispersion had an acid value of 0.6 mg KOH/g and a viscosity of 16 mPa*s before storage and an acid value of 1.3 mg KOH/g and a viscosity of 18 mPa*s after storage for 6 weeks at 50° C.

The composition achieved a softness rating of 31.

Examples 1 and 4 and comparative examples 2 and 3 clearly demonstrate that the fabric softener active compositions of the invention provide a significantly better softening performance in terms of soft touch and a better storage stability of a 10% aqueous dispersion compared to the fabric softener active compositions known from EP 1 018 541 A1 and DE 24 30 140 C3.

Example 5

2780 g (10.18 mol) fatty acid B was esterified with 783 g (5.36 mol) bis-(2-hydroxypropyl)-methylamine with 3 h reaction at reduced pressure until the acid value of the reaction mixture was 5.2 mg KOH/g. The resulting mixture was reacted with 642 g (5.10 mol) dimethylsulphate. The resulting fabric softener active composition was a white solid with a melting point of 41° C., containing 0.075 mmol/g (2.2% by weight) fatty acid and 0.123 mmol/g non-quaternised amine (0.068 mmol/g free amine and 0.055 mmol/g protonated amine). HPLC analysis showed the bis-(2-hydroxypropyl)-dimethylammonium methylsulphate fatty acid ester to be comprised of 5.5% monoester and 94.5% diester (rel. area percentages).

The composition had a melt viscosity of 2360 mPa*s at 1 $s^{-1}$, 1090 mPa*s at 10 $s^{-1}$ and 619 mPa*s at 100 $s^{-1}$ shear rate.

The 10% aqueous dispersion had an acid value of 0.8 mg KOH/g and a viscosity of 28 mPa*s before storage and an acid value of 2.8 mg KOH/g and a viscosity of 12 mPa*s after storage for 6 weeks at 50° C.

The composition achieved a softness rating of 35.

Example 6

1365 g (5.0 mol) fatty acid B was esterified with 384.2 g (2.63 mol) bis-(2-hydroxypropyl)-methylamine with 14 h reaction at reduced pressure until the acid value of the reaction mixture was 1.3 mg KOH/g. The resulting mixture was reacted with 315 g (2.5 mol) dimethylsulphate. The resulting fabric softener active composition was a white solid with a melting point of 43° C., containing 0.025 mmol/g (0.7% by weight) fatty acid and 0.113 mmol/g non-quaternised amine (0.081 mmol/g free amine and 0.032 mmol/g protonated amine). HPLC analysis showed the bis-(2-hydroxypropyl)-dimethylammonium methylsulphate fatty acid ester to be comprised of 5.7% monoester and 94.3% diester (rel. area percentages).

The composition had a melt viscosity of 16200 mPa*s at 1 $s^{-1}$, 4970 mPa*s at 10 $s^{-1}$ and 1530 mPa*s at 100 $s^{-1}$ shear rate.

The 10% aqueous dispersion had an acid value of 0.5 mg KOH/g and a viscosity of 19 mPa*s before storage and an acid value of 1.9 mg KOH/g and a viscosity of 13 mPa*s after storage for 6 weeks at 50° C.

The composition achieved a softness rating of 32.

Example 7

The esterification step of example 6 was repeated and 1021 g of the reaction mixture obtained was mixed with 45 g fatty acid B. The resulting mixture was reacted with 193 g (1.53 mol) dimethylsulphate. The resulting fabric softener active composition was a white solid with a melting point of 41° C., containing 0.151 mmol/g (4.15% by weight) fatty acid and 0.162 mmol/g non-quaternised amine (0.070 mmol/g free amine and 0.092 mmol/g protonated amine). HPLC analysis showed the bis-(2-hydroxypropyl)-dimethylammonium methylsulphate fatty acid ester to be comprised of 5.7% monoester and 94.3% diester (rel. area percentages).

The composition had a melt viscosity of 842 mPa*s at 1 $s^{-1}$, 663 mPa*s at 10 $s^{-1}$ and 619 mPa*s at 100 $s^{-1}$ shear rate.

The 10% aqueous dispersion had an acid value of 1.3 mg KOH/g and a viscosity of 23 mPa*s before storage and an acid value of 3.9 mg KOH/g and a viscosity of 8 mPa*s after storage for 6 weeks at 50° C.

The composition achieved a softness rating of 31.

Examples 5 to 7 demonstrate that the presence of fatty acid in the fabric softener active compositions of the invention contributes to a low melt viscosity of the composition, provides a closer to Newtonian rheology of the melt and does not adversely affect the viscosity of an aqueous dispersion of the composition during storage.

Example 8

Comparative, Higher Iodine Value 970 g (3.5 mol) fatty acid D was esterified with 287 g (1.84 mol) bis-(2-hydroxypropyl)-methylamine with 3 h reaction at reduced pressure until the acid value of the reaction mixture was 5.6 mg KOH/g. The resulting mixture was reacted with 221 g (1.75 mol) dimethylsulphate. The resulting fabric softener active composition was a yellow viscous liquid, containing 0.054 mmol/g (1.6% by weight) fatty acid and 0.129 mmol/g non-quaternised amine (0.068 mmol/g free amine and 0.061 mmol/g protonated amine). HPLC analysis showed the bis-(2-hydroxypropyl)-dimethylammonium methylsulphate fatty acid ester to be comprised of 6.6% monoester and 93.4% diester (rel. area percentages).

The composition had a melt viscosity of 581 mPa*s at 1 $s^{-1}$, 538 mPa*s at 10 $s^{-1}$ and 480 mPa*s at 100 $s^{-1}$ shear rate.

The 10% aqueous dispersion had an acid value of 0.9 mg KOH/g and a viscosity of 40 mPa*s before storage and an acid value of 2.6 mg KOH/g and a viscosity of 36 mPa*s after storage for 6 weeks at 50° C.

The composition achieved a softness rating of 23.

Example 8 demonstrates that a fabric softener active composition, which has fatty acid moieties of the quaternary ammonium salt with an iodine value higher than claimed, does not achieve a softening performance as high as that of the fabric softener active composition of the invention.

Example 9

Comparative, Shorter Average Chain Length 1125 g (5.25 mol) fatty acid E was esterified with 403 g (2.76 mol) bis-(2-hydroxypropyl)-methylamine with 2 h reaction at reduced pressure until the acid value of the reaction mixture was 4.1 mg KOH/g. The resulting mixture was reacted with 330 g (2.62 mol) dimethylsulphate. The resulting fabric softener active composition was a white gel, containing 0.049 mmol/g (1.1% by weight) fatty acid and 0.122 mmol/g non-quaternised amine (0.079 mmol/g free amine and 0.043 mmol/g protonated amine). HPLC analysis showed the bis-(2-hydroxypropyl)-dimethylammonium methylsulphate fatty acid ester to be comprised of 3.2% monoester and 96.8% diester (rel. area percentages).

The composition had a melt viscosity of 552 mPa*s at 1 $s^{-1}$, 550 mPa*s at 10 $s^{-1}$ and 497 mPa*s at 100 $s^{-1}$ shear rate.

The 10% aqueous dispersion had an acid value of 0.8 mg KOH/g and a viscosity of 30 mPa*s before storage and an acid value of 2.5 mg KOH/g and a viscosity of 79 mPa*s after storage for 6 weeks at 50° C.

The composition achieved a softness rating of 16.

Example 9 demonstrates that a fabric softener active composition, which has fatty acid moieties of the quaternary ammonium salt with an average chain length lower than claimed, does not achieve a softening performance as high as that of the fabric softener active composition of the invention.

Example 10

Comparative, Lower Molar Ratio of Fatty Acid Moieties to Amine Moieties 1032 g (3.78 mol) fatty acid B was esterified with 313.3 g (2.16 mol) bis-(2-hydroxypropyl)-methylamine with 2 h reaction at reduced pressure until the acid value of the reaction mixture was 4.6 mg KOH/g. The resulting mixture was reacted with 258.8 g (2.05 mol) dimethylsulphate. The resulting fabric softener active composition was a white solid with a melting point of 41° C., containing 0.047 mmol/g (1.3% by weight) fatty acid and 0.134 mmol/g non-quaternised amine (0.076 mmol/g free amine and 0.058 mmol/g protonated amine). HPLC analysis showed the bis-(2-hydroxypropyl)-dimethylammonium methylsulphate fatty acid ester to be comprised of 16.6% monoester and 83.4% diester (rel. area percentages).

The composition had a melt viscosity of 27100 mPa*s at 1 $s^{-1}$, 6040 mPa*s at 10 $s^{-1}$ and 1870 mPa*s at 100 $s^{-1}$ shear rate.

The 10% aqueous dispersion had an acid value of 0.9 mg KOH/g and a viscosity of 19 mPa*s before storage and an acid value of 2.5 mg KOH/g and a viscosity of 13 mPa*s after storage for 6 weeks at 50° C.

The composition achieved a softness rating of 27.

Example 10 demonstrates that a fabric softener active composition, which has a molar ratio of fatty acid moieties to amine moieties lower than claimed, does not achieve a softening performance as high as that of the fabric softener active composition of the invention.

Example 11

919 g (3.37 mol) fatty acid B was esterified with 245.7 g (1.68 mol) bis-(2-hydroxypropyl)-methylamine with 7 h reaction at reduced pressure until the acid value of the reaction mixture was 5.5 mg KOH/g. The resulting mixture was reacted with 201.3 g (1.60 mol) dimethylsulphate. The resulting fabric softener active composition was a white solid with a melting point of 43° C., containing 0.076 mmol/g (2.2% by weight) fatty acid and 0.141 mmol/g non-quaternised amine (0.084 mmol/g free amine and 0.057 mmol/g protonated amine). HPLC analysis showed the bis-(2-hydroxypropyl)-dimethylammonium methylsulphate fatty acid ester to be comprised of 0.9% monoester and 99.1% diester (rel. area percentages).

The composition had a melt viscosity of 1510 mPa*s at 1 $s^{-1}$, 687 mPa*s at 10 $s^{-1}$ and 553 mPa*s at 100 $s^{-1}$ shear rate.

The 10% aqueous dispersion had an acid value of 0.9 mg KOH/g and a viscosity of 31 mPa*s before storage and an acid value of 3.3 mg KOH/g and a viscosity of 12 mPa*s after storage for 6 weeks at 50° C.

The composition achieved a softness rating of 31.

Example 12

4823 g (17.68 mol) fatty acid F was esterified with 1337.4 g (9.16 mol) bis-(2-hydroxypropyl)-methylamine with 5 h reaction at ambient pressure and 5 h reaction at reduced pressure until the acid value of the reaction mixture was 4.6 mg KOH/g. The resulting mixture was reacted with 1096.5 g (8.70 mol) dimethylsulphate. The resulting fabric softener active composition was a white solid with a melting point of 38° C., containing 0.069 mmol/g (2.0% by weight) fatty acid and 0.130 mmol/g non-quaternised amine (0.071 mmol/g free amine and 0.059 mmol/g protonated amine). HPLC analysis showed the bis-(2-hydroxypropyl)-dimethylammonium methylsulphate fatty acid ester to be comprised of 5.9% monoester and 94.1% diester (rel. area percentages).

Example 13

4088 g (14.9 mol) fatty acid G was esterified with 1129.5 g (7.74 mol) bis-(2-hydroxypropyl)-methylamine with 4 h reaction at reduced pressure until the acid value of the reaction mixture was 3.7 mg KOH/g. The resulting mixture was reacted with 926.5 g (7.4 mol) dimethylsulphate. The resulting fabric softener active composition was a white solid with a melting point of 52° C., containing 0.066 mmol/g (1.9% by weight) fatty acid and 0.128 mmol/g non-quaternised amine (0.073 mmol/g free amine and 0.055 mmol/g protonated amine). HPLC analysis showed the bis-(2-hydroxypropyl)-dimethylammonium methylsulphate fatty acid ester to be comprised of 6.8% monoester and 93.2% diester (rel. area percentages).

Example 14

2520.4 g (9.23 mol) fatty acid B was esterified with 692.5 g (4.75 mol) bis-(2-hydroxypropyl)-methylamine with 5 h reaction at reduced pressure until the acid value of the reaction mixture was 6.1 mg KOH/g. The resulting mixture was reacted with 568.6 g (4.51 mol) dimethylsulphate for 1 h. Then 180.8 g dipropylene glycol was added and the mixture was homogenized by stifling. The resulting fabric softener active composition was a white solid with a melting point of 40° C., containing 0.083 mmol/g (2.4% by weight) fatty acid and 0.119 mmol/g non-quaternised amine (0.048 mmol/g free amine and 0.071 mmol/g protonated amine). HPLC analysis showed the bis-(2-hydroxypropyl)-dimethylammonium methylsulphate fatty acid ester to be comprised of 6.8% monoester and 93.2% diester (rel. area percentages).

The composition had a melt viscosity of 368 mPa*s at 1 $s^{-1}$, 340 mPa*s at 10 $s^{-1}$ and 318 mPa*s at 100 $s^{-1}$ shear rate.

Example 15

3214 g (11.77 mol) fatty acid B was esterified with 883.5 g (6.05 mol) bis-(2-hydroxypropyl)-methylamine with 4 h reaction at reduced pressure until the acid value of the reaction mixture was 3.3 mg KOH/g. Then 157 g refined coconut oil were added and the resulting mixture was reacted with 724.2 g (5.75 mol) dimethylsulphate for 1 h. Thereafter, 472 g 2-propanol were added and the mixture was homogenized by stirring. The resulting fabric softener active composition was a white solid with a melting point of 36° C., containing 0.049 mmol/g (1.4% by weight) fatty acid and 0.125 mmol/g non-quaternised amine (0.067 mmol/g free amine and 0.058 mmol/g protonated amine). HPLC analysis showed the bis-(2-hydroxypropyl)-dimethylammonium methylsulphate fatty acid ester to be comprised of 6.3% monoester and 93.7% diester (rel. area percentages).

Table 2 summarizes properties of the fabric softener active compositions prepared in the examples.

TABLE 2

Properties of the fabric softener active compositions

| Example | Fatty acid amine molar ratio | Fatty acid in wt-% | Melting point in ° C. | Melt viscosity at 1 $s^{-1}$ in mPa*s | Melt viscosity at 100 $s^{-1}$ in mPa*s | Acid value rise upon storage in mg KOH/g | Viscosity change upon storage in mPa*s | Softness rating |
|---|---|---|---|---|---|---|---|---|
| 1 * | 1.92 | 0.5 | <20 | 685 | 431 | 0.6 | 231 | 12 |
| 2 | 1.91 | 0.7 | 42 | 47200 | 2960 | 0.6 | 0 | 32 |
| 3 * | n.d. | 1.0 | ** | 561 | 469 | 0.7 | 110 | 24 |
| 4 | 1.97 | 0.9 | 43 | 36200 | 2160 | 0.7 | 2 | 31 |
| 5 | 1.95 | 2.2 | 41 | 2360 | 619 | 2.0 | −16 | 35 |
| 6 | 1.94 | 0.7 | 43 | 16200 | 1530 | 1.4 | −6 | 32 |
| 7 | 1.96 | 4.15 | 41 | 842 | 619 | 2.6 | −15 | 31 |
| 8 * | 1.93 | 1.6 | <20 | 581 | 480 | 1.7 | −4 | 23 |
| 9 * | 1.97 | 1.1 | ** | 552 | 497 | 1.7 | 49 | 16 |
| 10 * | 1.83 | 1.3 | 41 | 27100 | 1870 | 1.6 | −6 | 27 |
| 11 | 1.99 | 2.2 | 43 | 1510 | 553 | 2.4 | −19 | 31 |
| 12 | 1.94 | 2.0 | 38 | n.d. | n.d. | n.d. | n.d. | n.d. |
| 13 | 1.93 | 1.9 | 52 | n.d. | n.d. | n.d. | n.d. | n.d. |

TABLE 2-continued

Properties of the fabric softener active compositions

| Example | Fatty acid amine molar ratio | Fatty acid in wt-% | Melting point in ° C. | Melt viscosity at 1 $s^{-1}$ in mPa*s | Melt viscosity at 100 $s^{-1}$ in mPa*s | Acid value rise upon storage in mg KOH/g | Viscosity change upon storage in mPa*s | Softness rating |
|---|---|---|---|---|---|---|---|---|
| 14 | 1.93 | 2.4 | 40 | 368 | 318 | n.d. | n.d. | n.d. |
| 15 | 1.94 | 1.4 | 36 | n.d. | n.d. | n.d. | n.d. | n.d. |

* not according to the invention;
** gel;
n.d. = not determined

Examples

The following are non-limiting examples of the fabric softener compositions of the present invention.

| | FORMULATION EXAMPLES | | | | | | | |
|---|---|---|---|---|---|---|---|---|
| (% wt) | I | II | III | IV | V | VI | VII | VIII |
| FSA | 15[a] | 12.25[a] | 12.25[a] | 17[b] | 5[a] | 5[c] | 12.25[c] | 12.25[b] |
| Isopropyl Alcohol | 1.53 | 1.25 | 1.25 | — | 0.5 | — | — | — |
| Ethanol | — | — | — | 1.75 | — | — | — | — |
| Coconut Oil | 0.51 | 0.42 | 0.42 | 0.58 | 0.17 | 0.17 | — | — |
| Starch[d] | — | — | — | 0.8 | — | — | — | — |
| Thickening Agent[e] | 0.15 | 0.01 | 0.15 | — | 0.01 | 0.01 | — | — |
| Perfume | 0.5 | 4.0 | 2.4 | 1.25 | 0.5 | 1.5 | 4.0 | 4.0 |
| Perfume Micro-capsules[f] | — | — | — | 0.5 | — | — | — | — |
| Calcium Chloride | 0.10 | 0.05 | — | 0.19 | — | — | 0.10 | 0.10 |
| DTPA[g] | 0.05 | 0.05 | 0.05 | 0.008 | 0.05 | 0.05 | 0.05 | 0.05 |
| Preservative (ppm)[h] | 75 | 75 | 75 | 75 | 75 | 75 | 75 | 75 |
| Antifoam[i] | 0.005 | 0.005 | 0.005 | 0.014 | 0.005 | 0.005 | 0.005 | 0.005 |
| Dye (ppm) | 40 | 65 | 75 | 30 | 50 | 50 | 65 | 65 |
| HCl | 0.020 | 0.010 | 0.010 | 0.010 | 0.02 | 0.01 | 0.02 | 0.02 |
| Formic Acid | 0.025 | 0.025 | 0.025 | — | — | — | 0.025 | 0.025 |
| Deionized Water | Balance | Balance | Balance | Balance | Balance | Balance | Balance | Balance |

[a]Fabric Softening Active from the reaction product from Example 15.
[b]Fabric Softening Active from the reaction product from Example 12.
[c]Fabric Softening Active from the reaction product from Example 5.
[d]Cationic high amylose maize starch available from National Starch under the tradename HYLON VII ®.
[e]Rheovis CDE ex Ciba.
[f]Perfume microcapsules available ex Appleton
[g]Diethylenetriaminepentaacetic acid.
[h]Korelone B-119 (1,2-benzisothiazolin-3-one) available from Rohm and Haas. "PPM" is "parts per million."
[i]Silicone antifoam agent available from Dow Corning Corp. under the trade name DC2310 or Silicone MP10.

The invention claimed is:

1. A fabric softener composition comprising from 1% to 49% by weight of the composition of a bis-(2-hydroxypropyl)-dimethylammonium methylsulphate fatty acid ester having a molar ratio of fatty acid moieties to amine moieties of from 1.85 to 1.99, an average chain length of the fatty acid moieties of from 16 to 18 carbon atoms and an iodine value of the fatty acid moieties, calculated for the free fatty acid, of from 0.5 to 37.

2. The fabric softener composition of claim 1, characterised in that the iodine value of the fatty acid moieties, calculated for the free fatty acid, is from 15 to 35.

3. The fabric softener composition of claim 2, characterised in that it further comprises from 0.005% to 2.5% fatty acid by weight of the composition. lammonium methylsulphate fatty acid ester is from 55:45 to 75:25, respectively.

4. The fabric softener composition of claim 3, characterised in that the cis-trans-ratio of double bonds of unsaturated fatty acid moieties of the bis-(2-hydroxypropyl)-dimethy

5. The fabric softener composition of claim 1 comprising less than 5% by weight of the composition of a solvent, wherein the solvent is chosen from; ethanol, propanol, isopropanol, n-propanol, n-butanol, t-butanol, glycerol, ethylene glycol, trimethylene glycol, tetramethylene glycol, pentamethylene glycol, hexamethylene glycol, diethylene glycol, triethylene glycol, propylene glycol, dipropylene glycol and $C_1$-$C_4$ alkyl monoethers of ethylene glycol, propylene glycol, and dipropylene glycol, sorbitol, alkane diols such as 1,2 propanediol, 1,3 propanediol, 2,3-butanediol, 1,4-butanediol, 1,3-butanediol, 1,5-pentanediol, and 1,6 hexanediol; phenylethyl alcohol, 2-methyl 1,3-propanediol, hexylene glycol, sorbitol, polyethylene glycols, 1,2-hexanediol, 1,2-pentanediol, 1,2-butanediol, 1,4-cyclohexanedimethanol, pinacol, 2,4-dimethyl-2,4-pentanediol, 2,2,4-trimethyl-1,3-pentanediol (and ethoxylates), 2-ethyl-1,3-hexanediol, phenoxyethanol (and ethoxylates), glycol ethers, butyl carbitol, dipropylene glycol n-butyl ether, or combinations thereof.

6. The fabric softener composition of claim 5, further comprising from 0.015% to 1% by weight of the composition of a fatty acid triglyceride having an average chain length of the fatty acid moieties of from 10 to 14 carbon atoms and an iodine value, calculated for the free fatty acid, of from 0 to 15.

7. The fabric softener composition of claim 5, further comprising bis-(2-hydroxypropyl)methylamine fatty acid ester, containing the same fatty acid moieties as the bis-(2-hydroxypropyl)-dimethylammonium methylsulphate fatty acid ester.

8. The fabric softener composition of claim 6, further comprising bis-(2-hydroxypropyl)methylamine fatty acid ester, containing the same fatty acid moieties as the bis-(2-hydroxypropyl)-dimethylammonium methylsulphate fatty acid ester.

9. The fabric softener composition of claim 8, further comprising:

(a) 50% to 98% water by weight of the composition;

(b) 0.01% to 6% of perfume by weight of the composition;

(c) having a pH from 2 to 6.

10. The fabric softener composition of claim 9, wherein the perfume comprises a friable perfume microcapsule.

11. The fabric softener composition of claim 10, further comprises 0.1% to 5% by weight of a cationic cross-linked polymer that is from the polymerization of from 5 to 100 mole present of cationic vinyl addition monomer, from 0 to 95 mole percent of acrylamide, and from 50 to 1000 parts per million (ppm) of a vinyl addition monomer cross-linking agent.

12. A method for making a fabric softening composition comprising from 1% to 49% a fabric softening active according to claim 1, comprising the steps:

a) reacting bis-(2-hydroxypropyl)-methylamine with a fatty acid having an average chain length of from 16 to 18 carbon atoms and an iodine value of from 0.5 to 37 in a molar ratio of fatty acid to amine of from 1.86 to 2.1 with removal of water until the acid value of the reaction mixture is in the range from 1 to 10 mg KOH/g;

b) reacting the product of step a) with dimethylsulphate at a molar ratio of dimethylsulphate to amine of from 0.90 to 0.97 and preferably from 0.92 to 0.95 until the total acid value of the reaction mixture is in the range from 1 to 8 mg KOH/g;

c) hydrating with water; and d) adding a perfume.

13. A method of softening laundry comprising the step of administering a composition of claim 1 to a rinse cycle of an automatic laundry machine or a hand washing laundry rinse basin.

* * * * *

UNITED STATES PATENT AND TRADEMARK OFFICE

CERTIFICATE OF CORRECTION

PATENT NO. : 8,183,199 B2
APPLICATION NO. : 12/752220
DATED : May 22, 2012
INVENTOR(S) : Fossum et al.

It is certified that error appears in the above-identified patent and that said Letters Patent is hereby corrected as shown below:

Column 17

Lines 63-64, delete "lammonium methylsul-phate fatty acid ester is from 55:45 to 75:25, respectively."

Column 17

Line 67, after "bis-(2-hydroxypropyl)-dimethy" insert -- lammonium methylsulphate fatty acid ester is from 55:45 to 75:25, respectively. --

Signed and Sealed this
Ninth Day of October, 2012

David J. Kappos

David J. Kappos
*Director of the United States Patent and Trademark Office*